United States Patent [19]

Fu et al.

[11] Patent Number: 4,978,282

[45] Date of Patent: Dec. 18, 1990

[54] ELECTRICAL FUEL PUMP FOR SMALL MOTORCYCLE ENGINE

[75] Inventors: Shih-Lien Fu; Wu-Tsung Dent, both of Hsin-Chu, Taiwan

[73] Assignee: Industrial Technology Research Institute, Hsin-chu, Taiwan

[21] Appl. No.: 469,058

[22] Filed: Jan. 23, 1990

Related U.S. Application Data

[63] Continuation-in-part of Ser. No. 409,961, Sep. 18, 1989, which is a continuation of Ser. No. 156,738, Feb. 18, 1988, abandoned.

[51] Int. Cl.[5] ..... F04B 35/04; F04B 39/14

[52] U.S. Cl. ..... 417/360; 417/366; 417/410; 418/182; 403/354; 464/102

[58] Field of Search ..... 417/360, 366, 369, 410; 418/171, 182; 403/354; 464/102

[56] References Cited

U.S. PATENT DOCUMENTS

| | | | |
|---|---|---|---|
| 2,544,144 | 3/1951 | Ellis | 418/78 X |
| 3,881,849 | 5/1975 | Commarmot et al. | 418/182 |
| 4,008,018 | 2/1977 | McDermott | 418/177 |
| 4,171,939 | 10/1979 | Harwath | 403/354 X |
| 4,452,592 | 6/1984 | Tsai | 464/102 |
| 4,526,518 | 7/1985 | Wiernicki | 418/171 X |
| 4,645,430 | 2/1987 | Carleton | 418/171 X |
| 4,728,264 | 3/1988 | Tuckey | 417/44 |
| 4,834,623 | 5/1989 | Triolo et al. | 417/366 |
| 4,897,025 | 1/1990 | Negishi | 418/171 |
| 4,898,521 | 2/1990 | Sakurai et al. | 418/171 X |
| 4,922,781 | 5/1990 | Peiji | 418/171 X |

*Primary Examiner*—Leonard E. Smith

*Assistant Examiner*—Eugene L. Szczecina, Jr.

*Attorney, Agent, or Firm*—Cushman, Darby & Cushman

[57] ABSTRACT

This invention discloses an electrical fuel pump for a small motorcycle engine including an intake socket for introducing the fuel into the pump, a gerotor pump for compressing the incoming fuel, a discharge socket for discharging the compressed fuel from the pump, a DC motor for driving the gerotor pump, a coupling for transmitting the rotation power of the motor to the gerotor pump, and a casing for receiving the intake socket, the discharge socket, the gerotor pump, the coupling and the DC motor therein. The gerotor pump has a pair of engaged rotors, including a toothed inner rotor and a toothed outer rotor disposed eccentrically relative to each other, with a plurality of outer and inner teeth being, respectively, formed on the outer periphery of the inner rotor and on the inner periphery of the outer rotor so that the outer rotor may be driven by the inner rotor through engagement of the inner and outer teeth. A suction effect and a compression effect may be alternately achieved due to gradual changes in the volume of each cavity formed between engaged inner and outer teeth during the rotation of the pair of rotors so as to suck the fuel from the intake socket and then expel the fuel into the discharge socket. The coupling interconnects the DC motor and the gerotor pump in a manner allowing a slight relative axial movement and a slight axial misalignment between the motor shaft and the inner rotor so as to permit easy assembly. Furthermore, the coupling is made of engineering plastic so that power transmission may be achieved without metal-to-metal contact, thus permitting a quiet fuel pumping operation.

3 Claims, 5 Drawing Sheets

ELECTRICAL FUEL PUMP FOR SMALL MOTORCYCLE ENGINE

CROSS REFERENCE

This is a continuation-in-part of U.S. patent application Ser. No. 07/409,961, filed Sept. 18, 1989, which is a continuation of U.S. patent application Ser. No. 07/156,738, filed Feb. 18, 1988, now abandoned.

The inventors are aware of the following pertinent patents.

U.S. Pat. No. 4,728,264 to Tucky.
U.S. Pat. No. 4,645,430 to Carleton.
U.S. Pat. No. 4,526,518 to Wiernicki.
U.S. Pat. No. 2,544,144 to W. P. Ellis.
U.S. Pat. No. 4,500,270 to Tuckey.
U.S. Pat. No. 4,619,588 to Moore, III.
U.S. Pat. No. 4,475,341 to Inoue et al.
U.S. Pat. No. 4,546,746 to Sato et al.
U.S. Pat. No. 4,469,190 to Yamaguchi.
West Germany Patent No. 2,351,124 to Russell.

TECHNICAL FIELD

This invention relates to an electrical fuel pump which supplies fuel to a small motorcycle engine, having a displacement volume under 150 CC, at a low flow rate requiring only a low electric current, and which permits easy assembly and quiet fuel pumping operation.

BACKGROUND OF THE INVENTION

In the afore-mentioned U.S. patent application Ser. No. 07/156,738, an electrical fuel pump for a small motorcycle engine was proposed. After practical use, the proposed fuel pump was found to still suffer from two problems. Namely, it is noisy during fuel pumping operation and difficult to assemble.

SUMMARY OF THE INVENTION

The primary object of this invention is to provide an electrical fuel pump which not only meets the basic requirements of small motorcycle engines—capable of supplying fuel at a low rate requiring only a low electric current—but also permits easy assembly and quiet fuel pumping operation.

In accordance with this invention, an electrical fuel pump for small motorcycle engine comprises an intake socket for introducing the fuel into the pump, a gerotor pump for compressing the incoming fuel, a discharge socket for discharging the compressed fuel from the pump, a DC motor for driving the gerotor pump, a coupling for transmittimg the rotation power of the DC motor to the gerotor pump, and a casing for receiving the intake socket, the discharge socket, the gerotor pump, the coupling and the DC motor therein. The gerotor pump comprises an inlet plate adjacent to the intake socket, an exit plate adjacent to the DC motor, a ring-shape intermediate plate interposed between the inlet plate and the exit plate, and a pair of engaged rotors, including a toothed inner rotor and a toothed outer rotor received within a cavity surrounded by the inlet plate, the exit plate and the ring-shaped intermediate plate. The outer rotor is received in and guided by the inner periphery of the intermediate plate. The pair of toothed rotors is disposed eccentrically relative to each other. A plurality of outer teeth are formed on the outer periphery of the inner rotor and a plurality of inner teeth, more in number than the number on the outer teeth of the inner rotor, are formed on the inner periphery of the outer rotor so that the outer rotor may be driven by the inner rotor through engagement of the inner and outer teeth. A suction effect and a compression effect may be alternately achieved due to gradual changes in the volume of each cavity formed between engaged inner and outer teeth during the rotation of the pair of rotors so as to suck the fuel from the intake socket. The then compress the fuel through the discharge socket. The coupling interconnects the inner rotor of the gerotor pump and the shaft of the DC motor, allowing a slight relative axial movement and a slight axial misalignment between the motor shaft and the inner rotor, so as to transmit the rotation power of the DC motor to the inner rotor. The coupling comprises an intermediate section having a spline shaft-like profile, a first end section rotatably supported by the inlet plate, and a second end section rotatably supported by the exit plate and engaging the output end of the motor shaft in an axially slidable manner. The inner rotor includes a central hole having a shape identical to and slightly larger than the spline shaft-like intermediate section of the coupling so that the intermediate section may be inserted through and engage the central hole for driving the inner rotor.

BRIEF DESCRIPTION OF THE DRAWINGS

This invention will be more fully understood from the following detailed description, taken in connection with the accompanying drawings in which.

DETAILED DESCRIPTION OF THE PREFERRED EMBODIMENT

The construction of the electrical fuel pump in accordance with this invention will now be described with reference to the accompanying drawings.

Figure 1A:
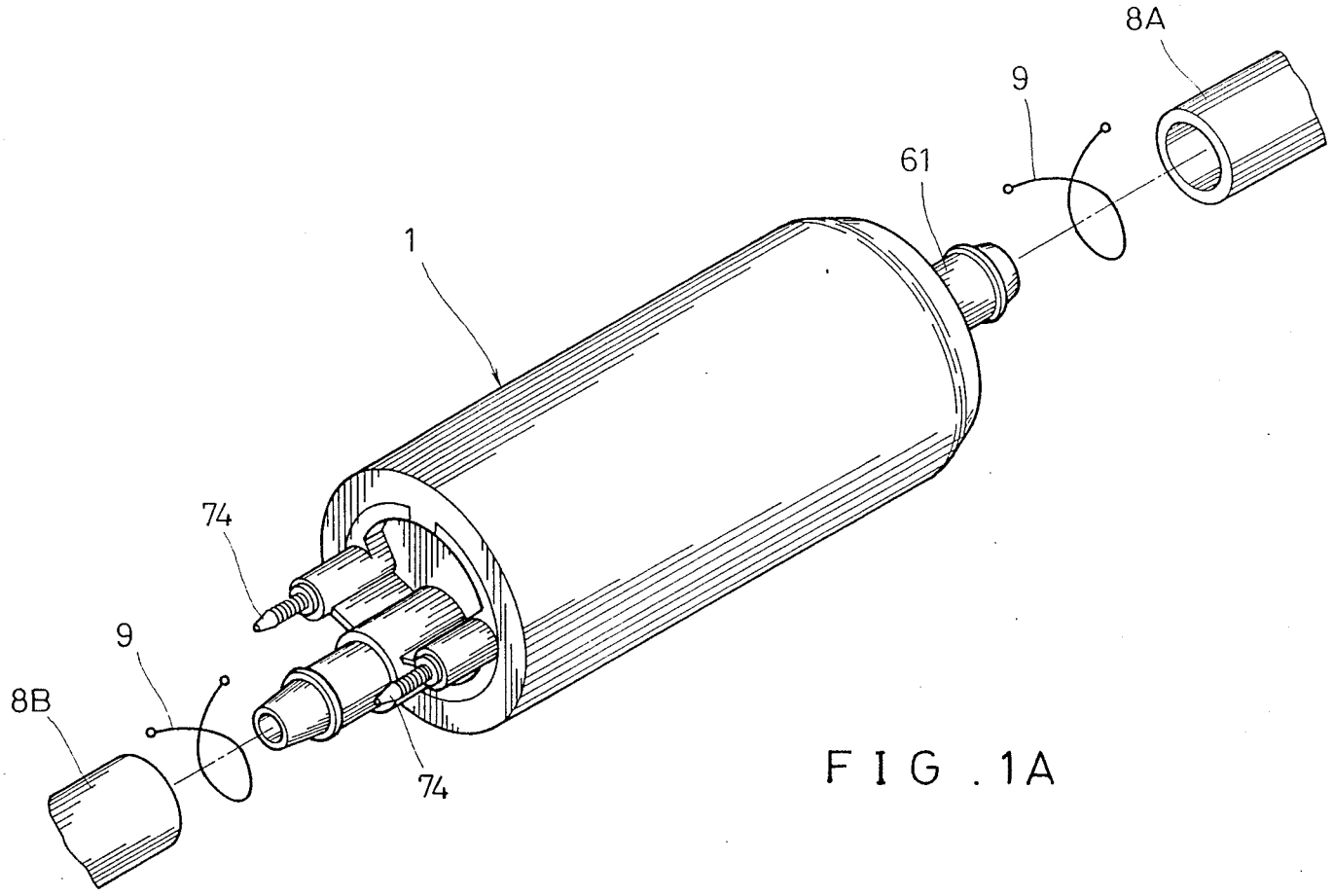
FIG. 1A is a perspective view of an electrical fuel pump in accordance with this invention and two fuel tubes to be connected to the intake and discharge sockets of the fuel pump.
Figure 1B:
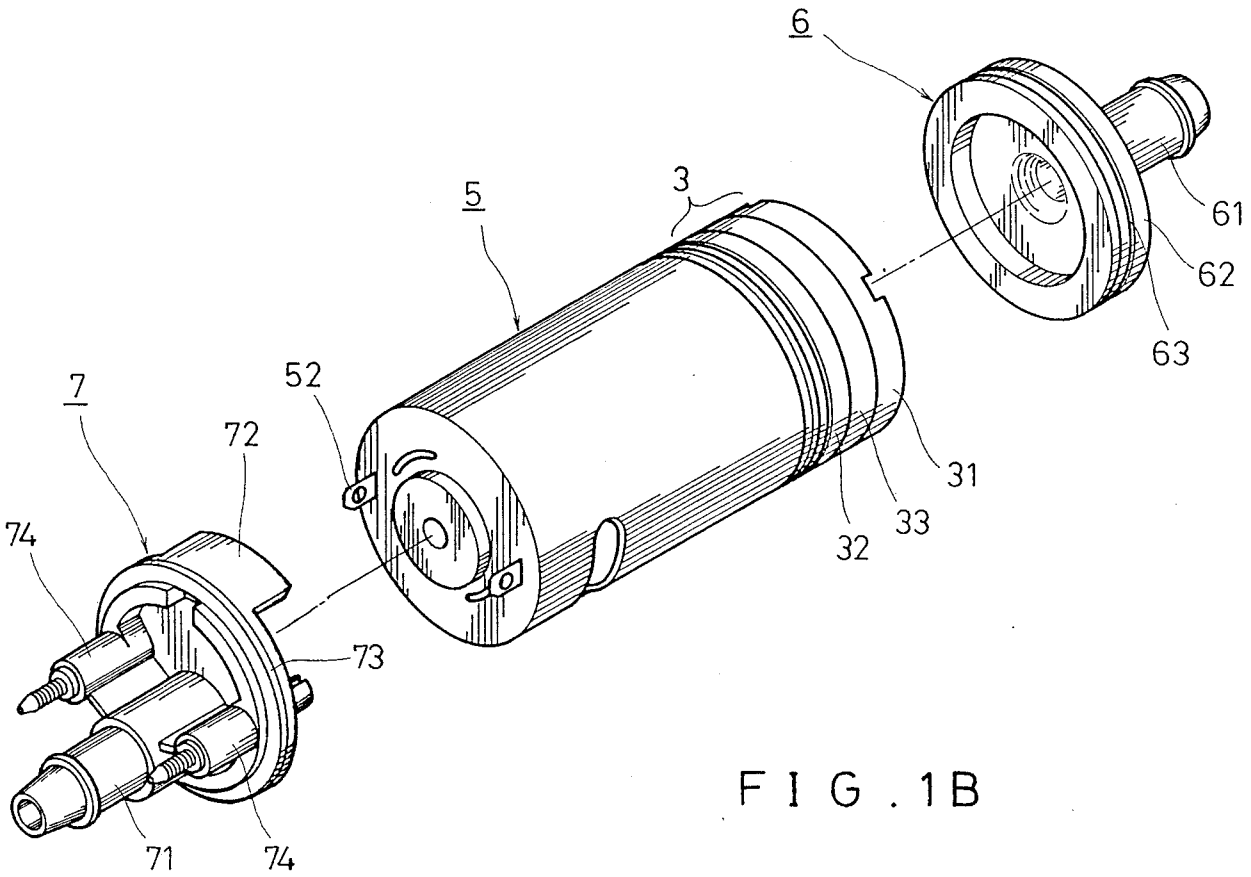
FIG. 1B is an exploded perspective view of the electrical fuel pump shown in FIG. 1A with the casing thereof being taken away.

From FIGS. 1A and 1B, it can be seen that the electrical fuel pump assembly 1 in accordance with this invention includes an intake socket 6 for introducing fuel into the pump assembly 1, a gerotor pump 3 for pumping the incoming fuel, a DC motor 5 for driving the gerotor pump 3, a discharge socket 7 for discharging the compressed fuel and a casing 10 for containing all the various parts of the fuel pump assembly 1. As is clear from FIGS. 1A, 1B, 1C and 2, DC motor 5 is assembled as an independent and complete unit prior to its reception within casing 10. The intake socket 6 is substantially of the shape of a hopper, comprising an intake conduit 61 and an enlarged portion 62 for being mounted into the casing 10, with an O-ring groove 63 being formed on the outer periphery of the enlarged portion 62 for receiving an O-ring R therein (also referring to FIG. 2) so as to avoid fuel leakage in an assembled state. Similarly, the discharge socket 7 is substantially of the shape of a hopper, comprising a discharge conduit 71, an enlarged portion 72 for being mounted into the casing 10 with an O-ring groove 73 being formed on the outer periphery of the enlarged portion 72 for receiving an O-ring R therein so as to avoid fuel leakage in an assembled state, and a pair of positive and negative conduction rods 74, integrally attached to the enlarged portion 72 during the injection molding procedure of the discharge socket 7, for contacting a corresponding pair of conduction pieces 52 of the motor 5 so as to conduct electric current from an outer power source to the motor 5. Each of the intake and discharge conduits 61 and 71 is connected to a fuel tube 8A or 8B on the inlet and exit sides of the pump assembly 1 by means of a fastening means such as a clip 9. As shown in FIG. 2, a check valve assembly comprising a valve body 75, a spring 76 and a retaining member 77 is provided in the discharge conduit 71 so that only the outward flow, not the inward flow, of fuel from the discharge conduit 71 is allowed. Thus, back flow of the fuel can be avoided and the fuel pressure in the discharge conduit 71 can be maintained at a certain level.

Figure 1C:
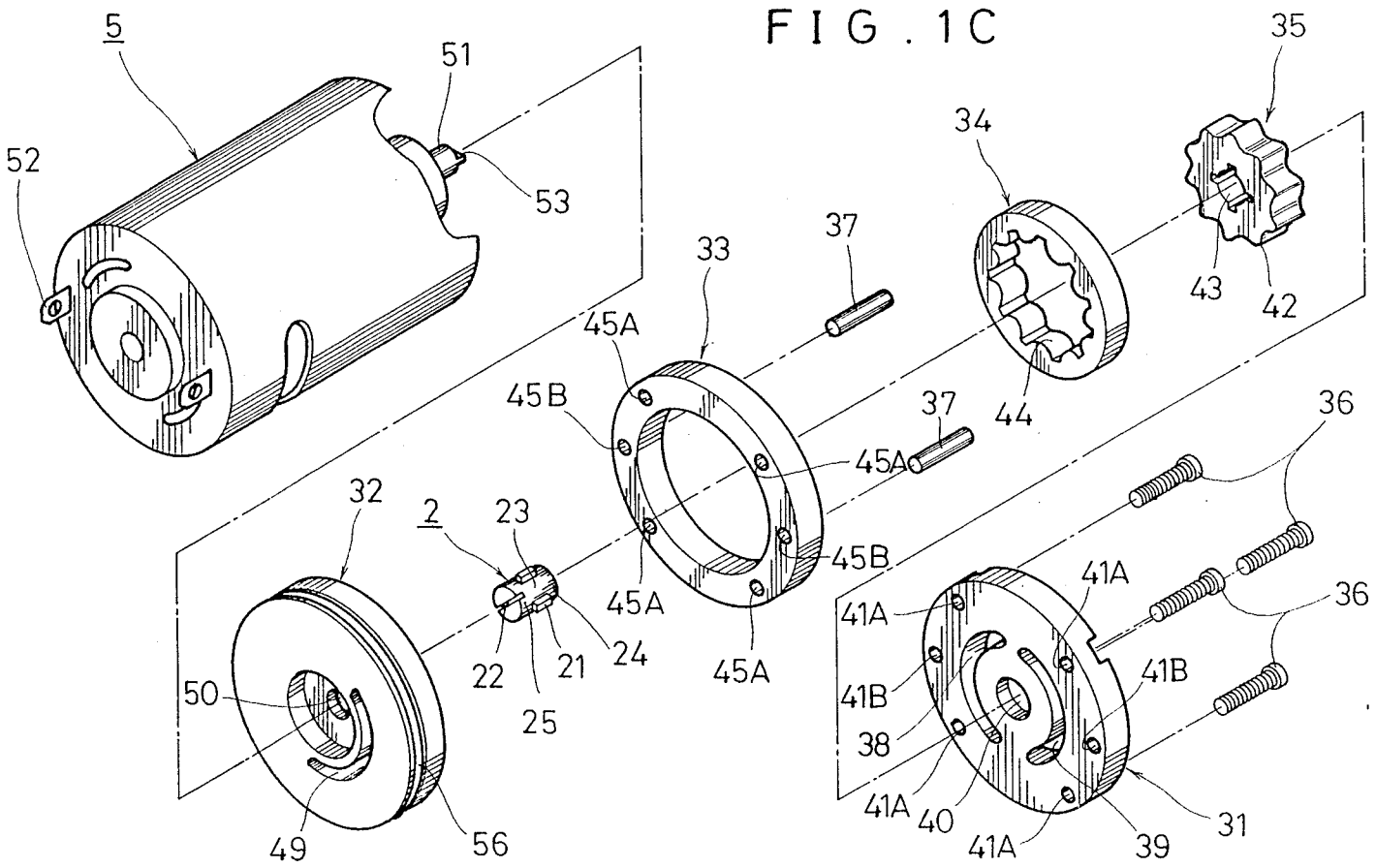
FIG. 1C is a further exploded perspective view of the DC motor and the gerotor pump as shown in FIG. 1B.
Figure 2:
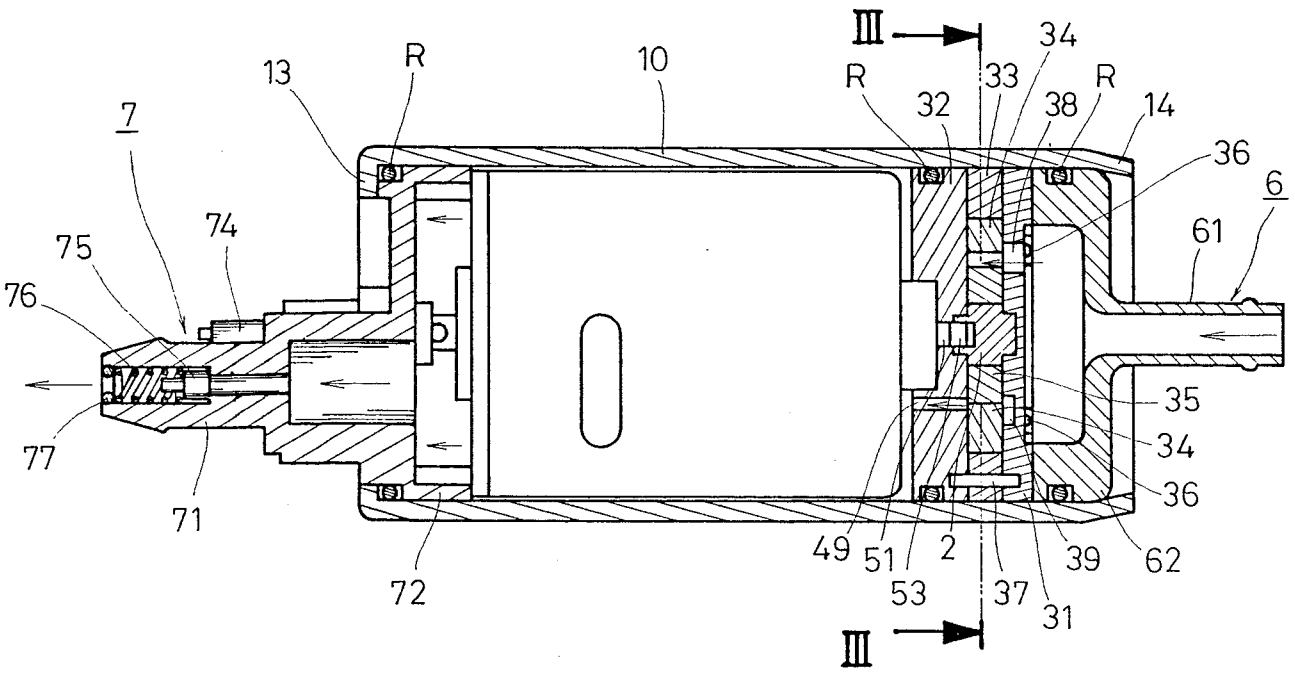
FIG. 2 is a longitudinal sectional view of the electrical fuel pump in FIG. 1A.

In FIG. 1C, the gerotor pump 3 is further disassembled. The gerotor motor 3 mainly comprises an inlet plate 31 adjacent to the intake socket 6, an exit plate 32 adjacent to the DC motor 5, a ring-shaped intermediate plate 33 interposed between the inlet plate 31 and the exit plate 32, and a pair of engaged rotors including a toothed rotor 35 and a toothed outer rotor 34 received within a disk-shaped cavity surrounded by the inlet plate 31, the exit plate 32 and the intermediate plate 33. The toothed inner rotor 35 and outer rotor 34 are disposed eccentrically relative to each other and coupled together through engagement of their teeth so that the outer rotor 34 may be driven by the inner rotor 35 which is, in turn, driven by the DC motor 5 as will be described in further detail later.

The inlet plate 31 is formed therein with a crescent inlet groove 38 through its entire thickness and a crescent pressure balance groove 39 which is disposed in a diametrically opposite direction relative to the groove 38 and extends from the surface adjacent to the engaged inner and outer rotors 34 and 35 partially through the thickness of the inlet plate 31. Besides, a central hole 40, facing the engaged rotor pairs 34 and 35 and extending partially through the thickness of the inlet plate 31, is formed at the central portion of the inlet plate 31.

The exit plate 32 is formed therein with a crescent exit groove 49 which is axially aligned with the pressure balance groove 39 and extends axially through the entire thickness of the exit plate 32. A through hole 50 is formed at the center of the exit plate 32 for passing the motor shaft 51 therethrough. An O-ring groove 56 is formed on the outer periphery of the exit plate 32 for receiving an O-ring R therein (also referring to FIG. 2) so as to avoid fuel leakage. Besides, a central hole (shown only in FIG. 2), facing the engaged rotor pairs 34 and 35 and extending partially through the thickness of the exit plate 32, is formed at the central portion of the exit plate 32.

The intermediate plate 33 is interposed between the inlet plate 31 and the exit plate 32, and is well finished by lapping process on its two sides adjacent to the above two plates 31 and 32 before being positioned relative to the inlet and exit plates 31 and 32 by means of two positioning pins 37 inserted through two corresponding pairs of pin holes 41B and 45B respectively in the inlet plate 31 and the intermediate plate 33, and also through two corresponding pin holes (shown only in FIG. 2, not in FIG. 1C) in the exit plate 32. Besides, the inlet plate 31, the intermediate plate 33 and the exit plate 32 are fastened together by means of four set screws 36 threaded through four corresponding holes 41A and threaded holes 45A in respective inlet plate 31 and intermediate plate 33, and also through four threaded holes (not shown in FIG. 1C) in the exit plate 32. Thus, the gaps between the three plates 31, 32 and 33 can be sealed off so as to avoid fuel leakage therethrough.

As can be seen from FIGS. 1C and 2, the shaft 51 of the DC motor 5 and the inner rotor 35 are interconnected with a coupling 2, preferably made of engineering plastic. The coupling 2 comprises an intermediate section 23 having a spline shaft-like profile including several parallel ribs 21 projecting diametrically outwards from the substantially cylindrical surface of the coupling 2, a first end section 24 received in and rotatably supported by the central hole 40 of the inlet plate 31, and a second end section 25 received in and rotatably supported by the afore-mentioned central hole of the exit plate 32. The second end section 25 is provided with a diametrally extending engaging slot 22 into which a flat driving portion 53 projecting axially outward from the central portion of the output end of the motor shaft 51 is inserted so that the motor shaft 51 may engage the coupling 2, allowing a slight axial misalignment and also a slight relative axial movement between the motor shaft 51 and the coupling 2.

The outer rotor 34 has a substantially ring-like shape and is received in and guided by the inner periphery of the intermediate plate 33 on its outer periphery. A plurality of inner teeth 44 (for example, eleven teeth as in the case of FIG. 4) is formed on the inner periphery of the outer rotor 34.

The inner rotor 35 is received in the central cavity of the outer rotor 34 and is formed on its outer periphery with several outer teeth 42 which are less than the number of the inner teeth 44 of the outer rotor 34 by one in number and which engage the inner teeth 44 of the outer rotor 34. The inner rotor 35 also includes a central hole 43 having a profile identical to and slightly larger than the spline shaft-like intermediate section 23 of the coupling 2 so that the intermediate section 23 may be inserted through and engage the central hole 43 for driving the inner rotor 35, allowing a slight axial movement of the coupling 2 relative to the the inner rotor 35. Consequently, the motor shaft 51 may drive the inner rotor 35 through interconnection of the coupling 2, and the inner rotor 35 may, in turn, drive the outer rotor 34 through engagement between the teeth of the rotors 34 and 35, allowing a slight axial misalignment and relative axial movement between the motor shaft 51 and the inner rotor 35. Namely, the motor shaft 51 and the gerotor 3 are interconnected by the coupling 2 in a "floating" manner which permits easy assembly.

The casing 10 is substantially of the shape of a hollow cylinder with two calking portions 13 and 14 being formed at its two ends so as to maintain and secure therein the intake socket 6, the discharge socket 7, the motor 5 and the gerotor pump 3. Since the whole motor 5 is immersed in fuel, the cooling of the motor 5 can be achieved by the fuel flowing through its interior. Besides, since air does not exist in the fuel pump, sparks will not be produced between the carbon brush and the commutator (not shown) of the motor 5 and thus the possibility of accidental fuel combustion can be completely avoided.

Figure 4:
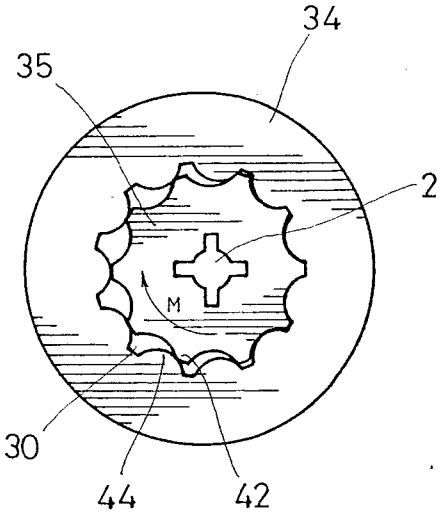
FIG. 4 is an enlarged fragmentary view of FIG. 3, showing the engagement between the inner and the outer rotors of the gerotor pump.
Figure 3:
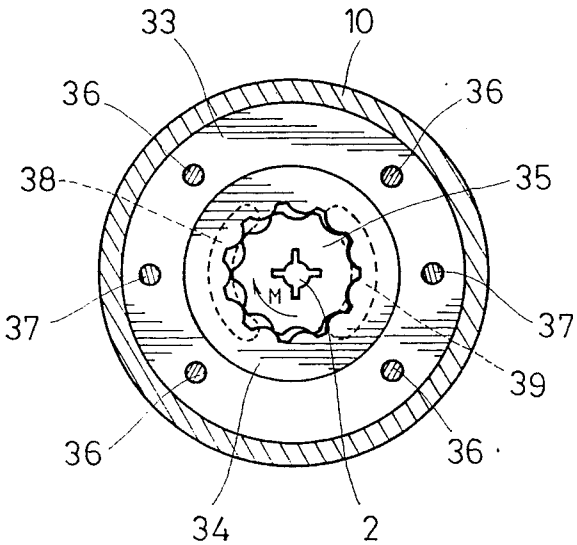
FIG. 3 is a cross-sectional view of the electrical fuel pump of FIGS. 1A or 2, taken along a line III—III in FIG. 2.

The function of the pump assembly 1 as per this invention will now be described with reference to FIGS. 2, 3 and 4.

Firstly, the motor 5 is actuated by supplying power thereto via the conduction rods 74 conduction pieces 52, and the gerotor pump 3 is driven by the motor 5 in a manner as described above. Since the inner rotor 35 and the outer rotor 34 are disposed eccentrically relative to each other, each cavity 30 formed between the engaged outer teeth 42 of the inner rotor 35 and the inner teeth 44 of the outer rotor 34 will gradually change its volume simultaneously with the rotation of the rotors. The inner and outer rotors 35 and 34 are properly arranged so that the cavities 30 which are axially aligned with the crescent inlet groove 38, namely those cavities 30 on the left half side of the rotors 34 or 35 in FIGS. 3 or 4, enlarge gradually during the rotation of the rotors, and a suction function is thus produced due to the gradual volume changes of the cavities 30. Consequently, when the pump assembly is driven by the motor 5 and the fuel is introduced into the pump assembly 1 through the intake conduit 61 of the intake socket 6, the fuel will flow, in the direction of the arrows as shown in FIG. 2, that is, from the right to the left. Namely, the fuel is first sucked from the intake conduit 61 via the crescent inlet groove 38 of the inlet plate 31 into the cavities 30. Then, after the inner rotor 35 has turned about 180 degrees, along the direction of arrow M (see FIGS. 3 and 4), each cavity 30 which was originally aligned with the inlet groove 38 of the inlet plate 31 reaches a position which is axially aligned with the crescent exit groove 49 formed in the exit plate 32. At this stage, the same cavity 30 reduces gradually simultaneously with the rotation of the rotors 34 and 35 so as to result in a compressing effect for expelling the fuel therefrom. Consequently, the fuel in the cavities 30 is compressed into the crescent exit groove 49 of the exit plate 32 and then discharged into an injector of an engine (not shown) through clearances within the motor 5 and through the discharge conduit 71 of the discharge socket 7. The existence of the pressure balance groove 39, in the inlet plate 31, which is axially aligned with and communicable with the exit groove 49, will allow a pressure balance of the fuel in the two grooves 39 and 49 so that the forces exerted on both sides of the inner and outer rotors 35 and 34 can be balanced.

An electrical fuel pump according to this invention having the afore-described construction not only meets the basic requirements of small motorcycle engines—capable of supplying fuel at a low flow rate requiring only a low electric current—but also permits easy assembly because, through interconnection of the DC motor 5 and the gerotor pump 3 by means of a "floating" coupling 2 which allows a slight axial misalignment and a slight relative axial movement between the motor shaft 51 and the inner rotor 35 of the gerotor pump 3, it is possible to first assemble together the comprising parts 31, 32, 33, 34 and 35 of the gerotor pump 3 into a pump subassembly prior to connecting the latter to the DC motor 5 and no laborious alignment is required during the assembling procedure of the gerotor pump 3 and the motor 5. Besides, since slight axial misalignment is allowable, no break-down will occur upon fuel pumping even in the case when slight axial misalignment does exist between the motor shaft 51 and the inner rotor 35 of the gerotor pump 3. Furthermore, since the coupling 2 interconnecting the motor shaft 51 and the inner rotor 35 of the gerotor pump 3 is made of engineering plastic, noise produced during fuel pumping can be greatly reduced as compared with the case when metal-to-metal contact is required for power transmission.

While this invention has been described in terms of an embodiment, it is to be understood that the invention need not be limited to the disclosed embodiment. On the contrary, it is intended to cover various modifications included within the spirit and scope of the appended claims.

What is claimed is:

1. An electrical fuel pump for a small motorcycle engine comprising an intake socket for introducing the fuel into said pump, a georor pump for pumping said incoming fuel, a discharge socket for discharging said compressed fuel from said pump, a DC motor for driving said gerotor pump and a casing for receiving said intake socket, said discharge socket, said gerotor pump and said DC motor therein;

said gerotor pump comprising an inlet plate adjacent to said intake socket, an exit plate adjacent to said DC motor, a ring-shaped intermediate plate, having an inner periphery, interposed between said inlet plate and said exit plate, and a pair of engaged rotors, including a toothed inner rotor an a toothed outer rotor received within a cavity surrounded by said inlet plate, said exit plate and said ring-shaped intermediate plate, said outer rotor received in and guided by the inner periphery of said intermediate plate; said pair of toothed rotors being disposed eccentrically relative to each other, a plurality of outer teeth being formed on the outer periphery of said inner rotor and a plurality of inner teeth, more in number than the number on said outer teeth of said inner rotor, being formed on the inner periphery of said outer rotor so that said outer rotor may be driven by said inner rotor through engagement of said inner and outer teeth, and a suction effect and a compression effect may be alternately achieved due to gradual changes in the volume of each cavity formed between engaged inner and outer teeth during the rotation of said pair of rotors so as to suck the fuel from said intake socket and then compress the fuel into said discharge socket;

characterized by:

a coupling interconnecting said inner rotor and the shaft of said DC motor for transmitting the rotation power of said DC motor to said inner rotor; said coupling comprising an intermediate section having a spline shaft-like profile, a first end section rotatably supported by said inlet plate, and a second end section rotatably supported by said exit plate and engaging the output end of said motor shaft, allowing a slight relative axial movement and a slight axial misalignment between said coupling and said motor shaft;

said inner rotor including a central hole having a shape indentical to and slightly larger than said spline shaft-like intermediate section of said coupling so that said intermediate section may be inserted through and engage said central hole for driving said inner rotor, allowing a slight axial movement of said coupling relative to said inner rotor;

whereby said coupling interconnects said DC motor and said gerotor pump in a manner allowing a slight relative axial movement and a slight axial misalignment between said motor shaft and said inner rotor.

2. An electrical fuel pump as described in claim 1, wherein said coupling is made of engineering plastic.

3. An electrical fuel pump as described in claim 1, wherein said inlet plate, said intermediate plate and said exit plate are positioned by positioning pins and locked together by set screws so as to reduce clearances between said plates.

* * * * *